United States Patent [19]

Wisniewski

[11] 4,221,386

[45] Sep. 9, 1980

[54] RING AND LOOP PUZZLE

[76] Inventor: Rafael Wisniewski, Box 94, Station A, Vancouver, B.C., Canada, V6C 2L8

[21] Appl. No.: 901,701

[22] Filed: May 1, 1978

[51] Int. Cl.[2] ..... A63F 9/08

[52] U.S. Cl. ..... 273/159

[58] Field of Search ..... 273/158, 159

[56] References Cited

U.S. PATENT DOCUMENTS

| | | | |
|---|---|---|---|
| 2,324,566 | 7/1943 | Davis | 273/159 |
| 3,997,168 | 12/1976 | Paige | 273/159 |

*Primary Examiner*—Anton O. Oechsle

*Attorney, Agent, or Firm*—Barrigar & Company

[57] ABSTRACT

A ring and loop puzzle having a pair of spaced vertically upstanding members affixed at their bottom to a common rigid base and at their top to an upper frame section having an aperture therein. To each of the rods are rigidly affixed a set of horizontally extending posts vertically aligned and spaced such that the posts of one set alternate but only partially mesh with the posts of the other set. The ends of the posts are formed into eyes which loosely capture respective rings that hang vertically downward such that each ring encircles two underlying posts between the eye and fixed end of each such underlying post, except that the ring next to the bottom encircles only one underlying post and the bottom ring, no posts. Used in conjunction with the puzzle is a flexible closed loop line which is manipulated through and over the rings in working the puzzle. The unique arrangement of the posts and associated rings makes this puzzle relatively different and somewhat more complicated to solve than those disclosed by the prior art.

6 Claims, 79 Drawing Figures

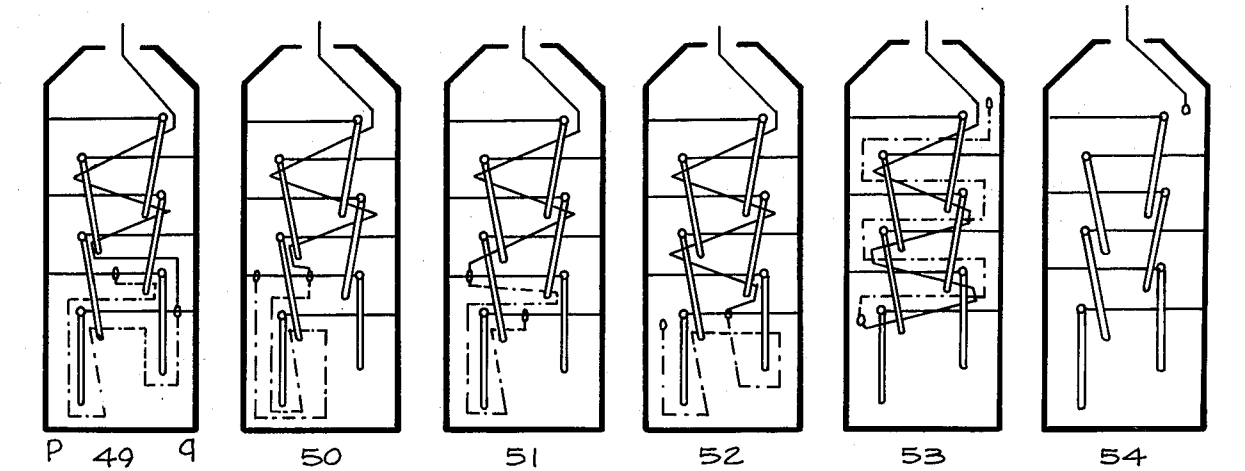
Fig'5
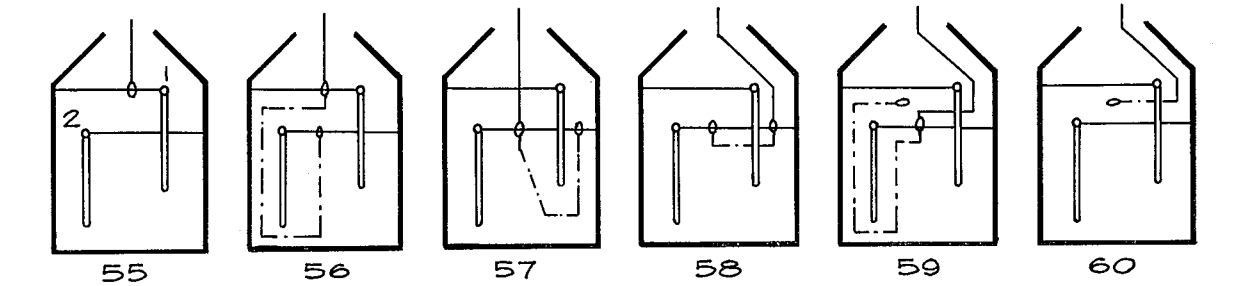
Fig'5

RING AND LOOP PUZZLE

BACKGROUND OF THE INVENTION

This invention discloses a unique ring and loop puzzle of a type generally similar in principle to the conventional Chinese ring and loop type of puzzle which has been known for many years.

A variant of the conventional Chinese ring and loop type of puzzle is disclosed in U.S. Pat. No. 3,997,168, Paige, Dec. 14, 1976 which features a linear arrangement of upstanding posts and a plurality of rings which pass through respective eyes or eyelets, one such eye being located at the top of each post. Each ring encircles the adjacent post in a forward direction so that each ring is interrelated with the next adjacent ring. The object of the game is to disengage a loop, both side members of which initially pass through all the rings and lie on either side of the posts. Another variant of the conventional ring and loop puzzle is illustrated in U.S. Pat. No. 2,324,566, Davis, July 20, 1943 which has a linear series of horseshoe shaped interlocking wire loops each loop being parallel to and extending above a base and having a stem portion connected to a base through the bight portion of an adjacent loop. A continuous cord encircling the stem of a terminal loop is manipulated along and through the various loops in succession until it is completely disengaged. Each of the foregoing devices discloses a linear arrangement of interconnected rings supported from a base structure by either upstanding posts or by direct connection to the base and involve substantially the same sequence of operations to effect their solution.

It is an object of the present invention to provide a unique ring and loop puzzle structure which requires a relatively complicated sequence of operations different from those required for the solution of previously known puzzles, to effect the solution of the puzzle.

It is a further object of the present invention to provide a structure for a puzzle of the type mentioned above which is simple and inexpensive to manufacture.

SUMMARY OF THE INVENTION

The present invention discloses a ring and loop puzzle which in a preferred embodiment comprises a pair of substantially parallel vertically upstanding spaced rigid columns joined at their bottom to a common rigid base and at their top to a neck annulus. Rigidly attached to the said columns is a first and second set of horizontally extending posts, the posts of each set being of substantially uniform length and aligned in a common vertical plane with the vertical spacing between the posts being substantially the same for all sets of adjacent posts. The posts of the first set partially mesh with those of the second set with each post having an eye formed at or near the end thereof. A plurality of closed rings of substantially equal diameter pass through respective eyes of the posts. The ring diameter is such that each ring other than the two bottom-most rings, encircles two underlying posts between the eye and fixed end of each such underlying post; the ring next to the bottom ring encircling one underlying post and the bottom ring encircling no other posts. A flexible closed loop line having a cross-section selected to permit its easy passage when doubled through the neck annulus and of a length sufficient to extend through the said neck annulus and through each one of the rings in succession is provided for working the puzzle. Attached to the end of the closed loop is an object of dimensions larger than the aperture.

The foregoing description represents a commercial embodiment of the device which may be more rigorously described as a ring and loop puzzle comprising a neck annulus, a pair of depending substantially parallel columns fixed to and extending from circumferentially spaced portions of the neck annulus, p mutually spaced posts extending from the first of said columns, the ends of said p posts spaced from the second column and q mutually spaced posts alternating with the p posts and extending from the second of said columns in the direction of the first of the columns, the ends of the said q posts spaced from the first columns and the first p post being closest to the neck annulus. In the case p=q, q being an integer of value at least 2, each of the p posts is provided with a connected ring whereby the first, . . . (p−1)th ring encircles the second, . . . pth post at a point nearer the first column than the point of connection of the ring connected to the encircled one of said p posts and also encircles the first, . . . (q−1)th posts at a point nearer the second column than the point of connection of the ring connected to the encircled one of said q posts, respectively, with the pth ring encircling the qth post, and at least the first, . . . (q−1)th posts are each provided with a connected ring whereby the first, . . . (q−1)th ring encircles the second, . . . pth post at a point nearer the first column than the point of connection of the ring connected to the encircled one of said p posts and also encircles the second, . . . qth post at a point nearer the second column than the point of connection of the ring connected to the encircled one of said q posts. In the case $p-q=1$, at least each of the first, . . . (p−1)th posts is provided with a connected ring whereby the first, . . . (p−1)th ring encircles the second, . . . pth post at a point nearer the first column than the point of connection of the ring connected to the encircled one of said posts and also encircles the first, . . . qth post at a point nearer the second column than the point of connection of the ring connected to the encircled one of said q posts, respectively. In addition, each of the q posts is provided with a connected ring whereby the first, . . . (q−1)th ring encircles the second, . . . (p−1)th post at a point nearer the first column than the point of connection of the ring connected to the encircled one of said p posts and also encircles the second, . . . qth posts at a point nearer the second column than the point of connection of the ring connected to the encircled one of said q posts respectively with the qth ring encircling the pth post. The rings connected to the p posts are closer to the second column than to the first column and the rings connected to the q posts are closer to the first column than to the second column. The puzzle also comprises a flexible closed loop line having a length sufficient to permit passage of the doubled line through the neck annulus and all of the rings.

The loop and puzzle for the more trivial case of a two or three ring puzzle comprises a neck annulus, a pair of substantially parallel depending columns fixed to and extending from circumferentially spaced portions of the neck annulus, a first post or first set of two mutually spaced posts extending from the first of the depending columns, in the direction of the second of the columns, the end of the said first post or ends of said first set of two posts spaced from the second column and a second post extending from the second of the columns in the direction of the first of the columns and spaced apart from and having the first post or one post of the first set of two posts interposed between said second post and the neck annulus, the end of said second post spaced from the first column. In the case where there is only one post extending from the first column it is provided with a connected ring which encircles the post extending from the second of the columns. In the case where there are two posts extending from the first of the columns, said second post is interposed between the posts of said first set of two posts, said one post nearest the annulus and said second post each being provided with connected rings, the rings of said one post encircling said other post and said second post, the latter at a point nearer the second column than the point of connection of the ring connected to said second post and the ring of said second post encircling said other post. The puzzle additionally comprises a flexible closed loop line having a length sufficient to permit passage of the doubled line through the neck annulus and through all of the rings.

The integral formation of the base, columns, posts and neck annulus results in a structure that is particularly suitable for manufacturing by plastic moulding techniques and provides a structure which is readily accessible from all sides so as to facilitate the threading of the loop through the rings.

SUMMARY OF THE DRAWINGS

FIG. 1B is a schematic view of the six-ring puzzle of FIG. 1A showing the cord in initial or starting position.

FIGS. 2–54 are schematic views similar to FIG. 1B showing the cord successively in second to fifty-fourth positions, respectively.

FIG. 55 is a schematic view of a two-ring puzzle variant constructed according to the invention, showing the cord in initial or starting position.

FIGS. 56–60 are similar schematic views of the puzzle variant of FIG. 55 showing the cord successively in second to sixth positions, respectively.

FIG. 61 is a schematic view of a three-ring puzzle variant constructed according to the invention, showing the cord in initial or starting position.

FIGS. 62–66 are similar schematic views of the puzzle variant of FIG. 61 showing the cord successively in second to sixth positions, respectively.

FIG. 67 is a schematic view of a four-ring puzzle variant constructed according to the invention, with the cord shown in starting position.

FIGS. 68–78 are similar schematic views of the puzzle variant of FIG. 67 showing the cord successively in second to twelfth positions, respectively.

DETAILED DESCRIPTION WITH REFERENCE TO THE DRAWINGS

Figure 1A:
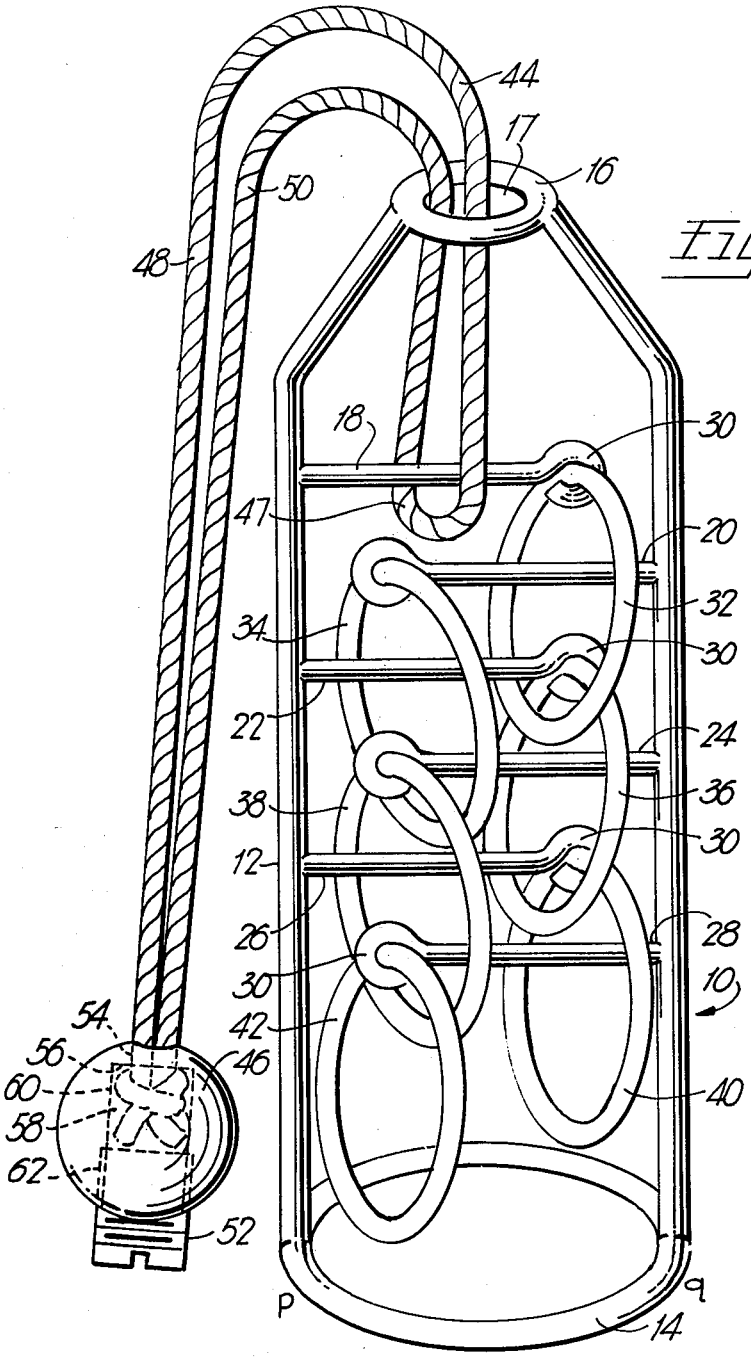
FIG. 1A is a perspective view of an embodiment of a six-ring and loop puzzle assembly constructed according to the invention, with the cord shown in starting position.
Figure 5:
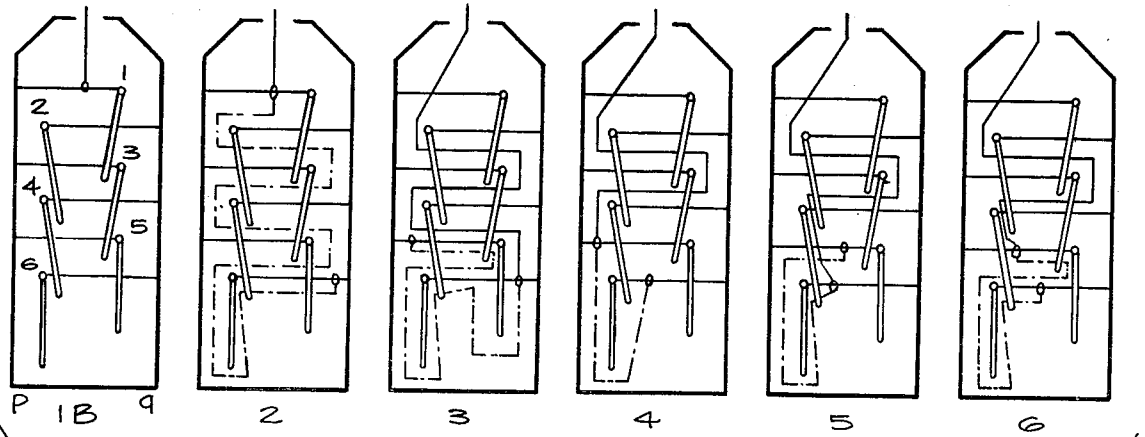
Figure 5:
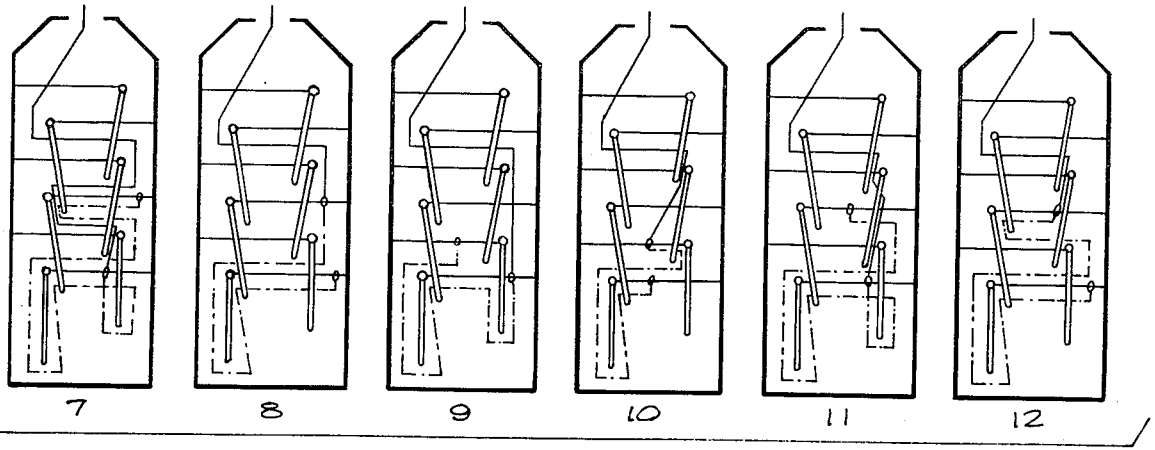
Figure 5:
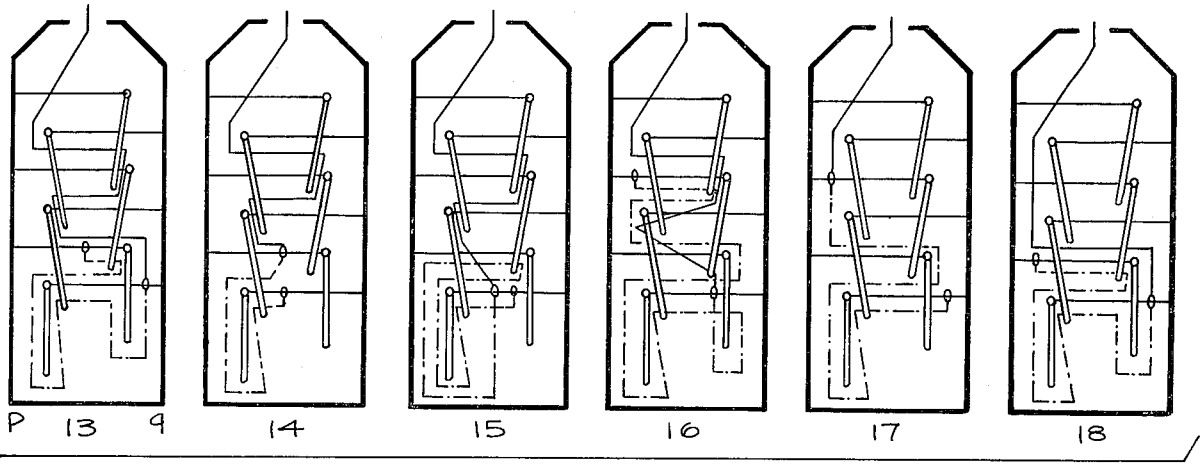
Figure 5:
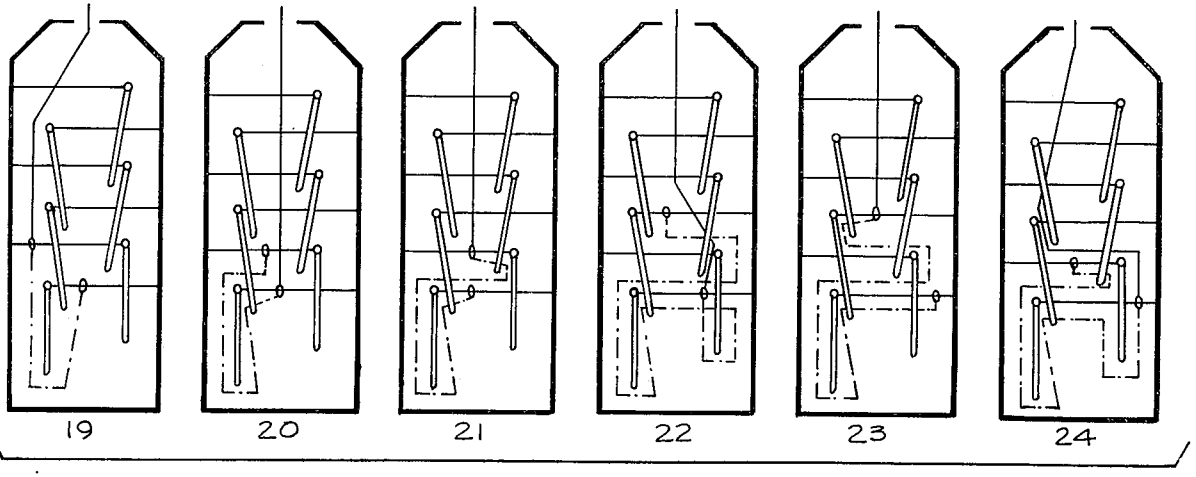
Figure 5:
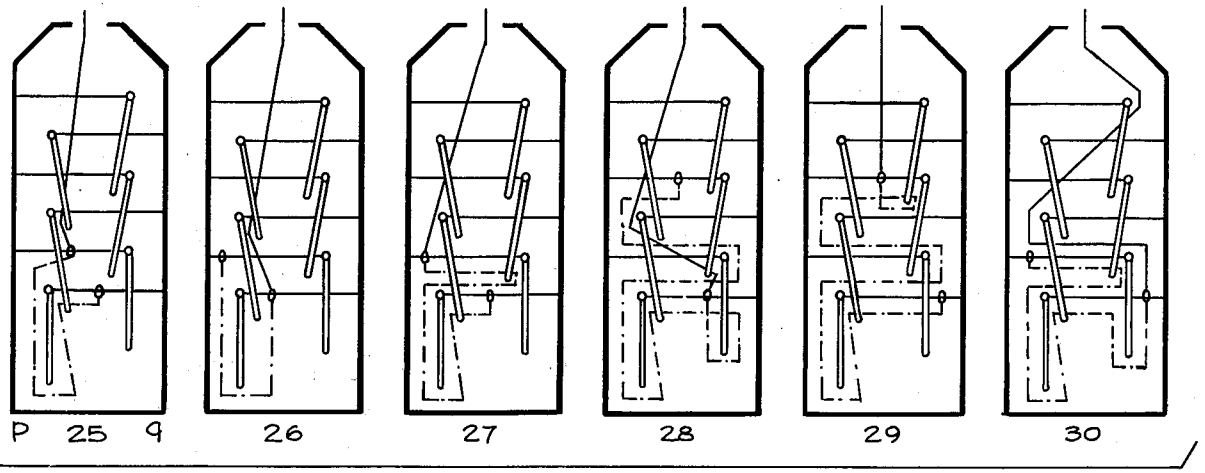
Figure 5:
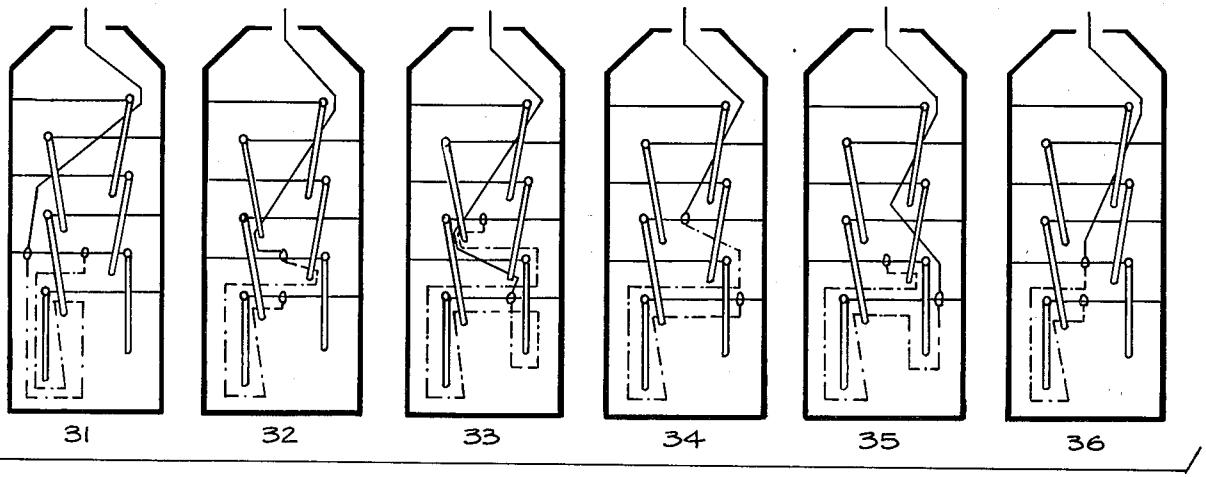
Figure 5:
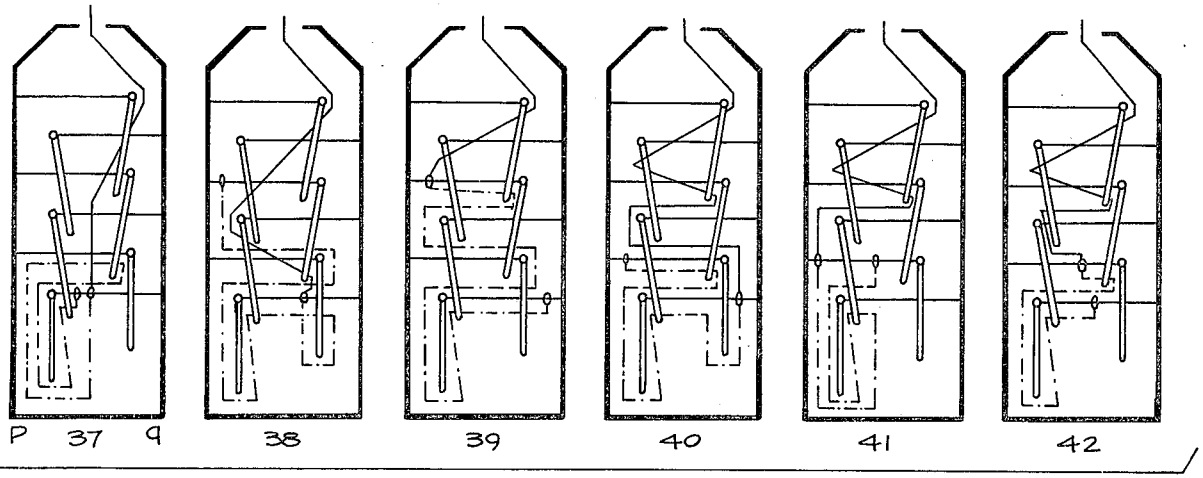
Figure 5:
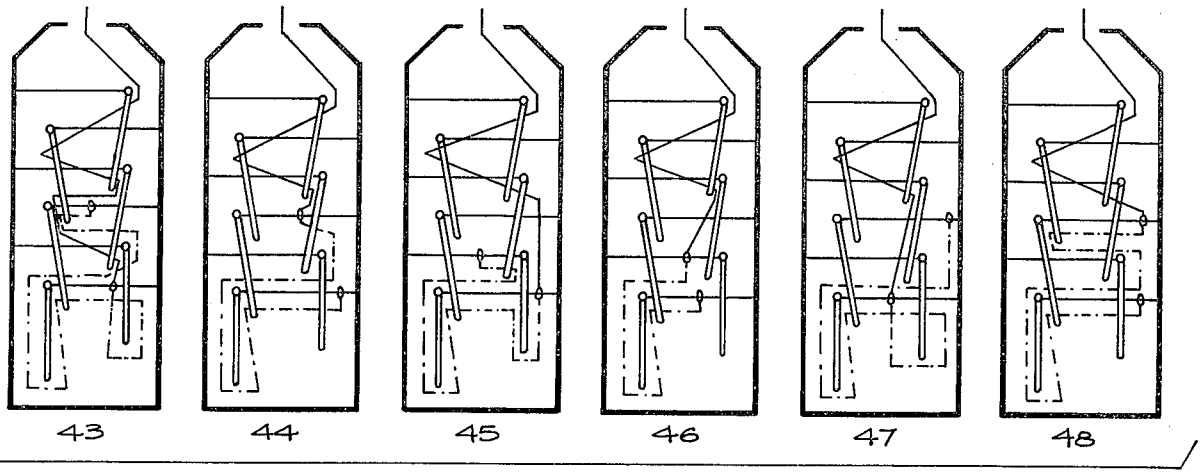
Figure 5:
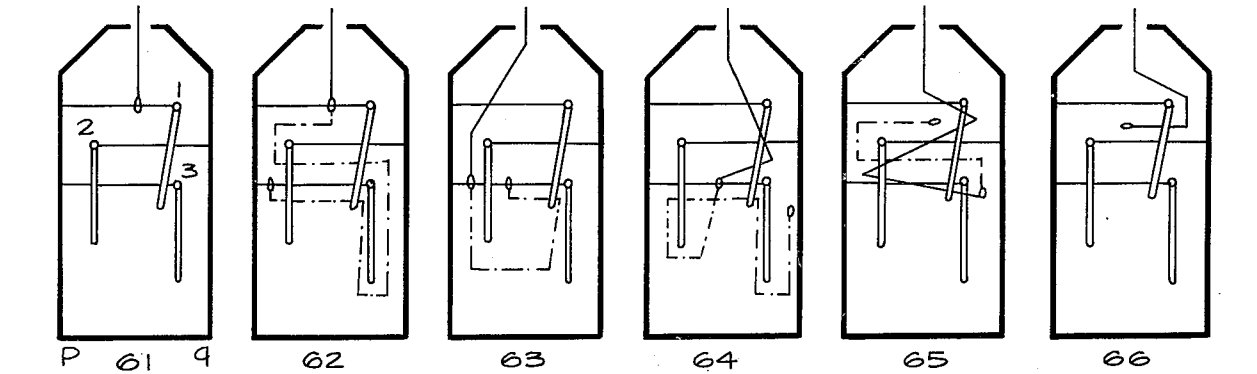
Figure 5:
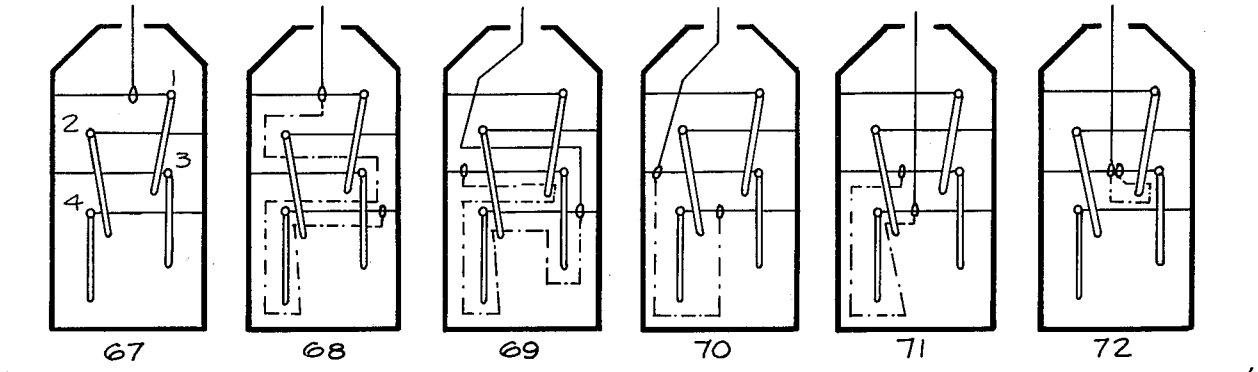
Figure 15:
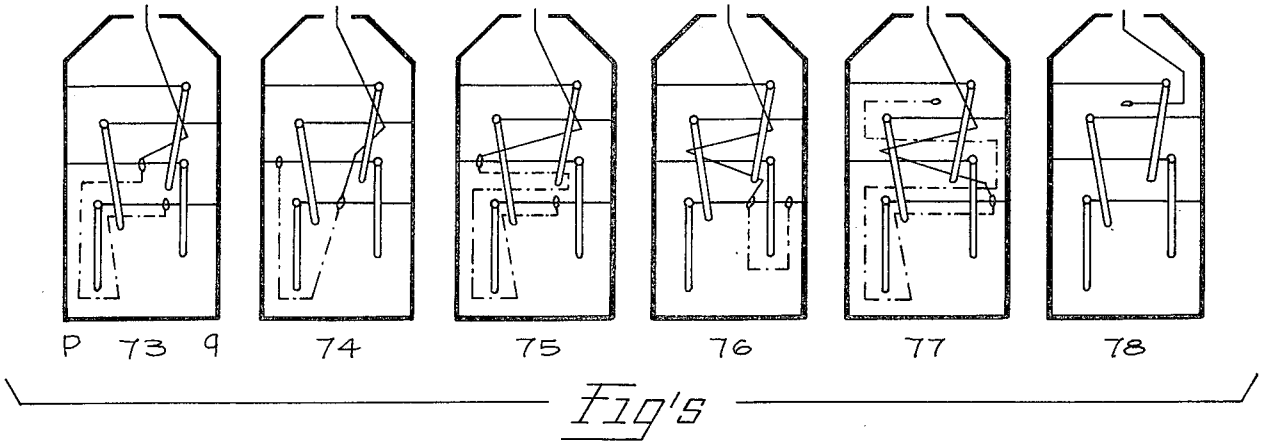

The six-ring puzzle variant illustrated in FIG. 1A comprises two parallel vertically upstanding columns 10 and 12 which are affixed at diametrically opposite points to a base annulus 14. The upper portion of the two columns 10 and 12 are bent inwardly and are affixed at their uppermost end to diametrically opposite points of a neck annulus 16 having an aperture 17. To each of the vertical columns 10 and 12 are rigidly fastened horizontally extending posts 18, 20, 22, 24, 26, and 28 which are of substantially uniform length and are aligned to lie in a common vertical plane. Each of the posts is spaced apart from adjacent posts by a fixed vertical distance which is the same for all such posts. The posts are arranged so that those posts 18, 22 and 26 affixed to one column 12 partially mesh with those posts 20, 24 and 28 affixed to the other column 10. The free ends of the posts are spaced from their respective opposing columns and are formed into closed eyes 30 which loosely capture closed rings 32, 34, 36, 38, 40 and 42. Each of the rings 32, 34, 36 and 38 are installed such that the bottom portion of each such ring lies closer to the central vertical axis of the base than does the upper portion of its corresponding ring 36, 38, 40 and 42, respectively located directly underneath. The foregoing structure is used in conjunction with a closed loop line 44, one end of which is affixed to a ball 46, having a diameter larger than that of the aperture 17 of the neck annulus 16 and the other end of which 47 in starting position is looped around the uppermost post 18. The closed loop line when extended as shown in FIG. 1A has two side members 48 and 50. Typically the line 44 may be made of nylon or other material in such a way so as to produce a flexible line. The ball 46 which may be constructed of any light material such as wood or plastic has a central main bore 60 threaded at a plug end 62 to threadedly receive a mating plug 52. At the end opposite the plug end 62 a small bore 54 of a diameter slightly larger than twice the diameter of the cord 44, but smaller than the diameter of the main bore 60 meets the latter concentrically to form a shoulder 56 such that, in situ, a knot tied in the ends of the cord 44 rests in the cavity 58 of the main bore 60 between the end of the plug 52 and the shoulder 56 and is of a size such that it cannot pass through the small bore 54.

With a six-ring puzzle assembled as illustrated in FIG. 1A, a person may proceed to manipulate the closed loop line 44 relative to the posts 18, 20, 22, 24, 26, 28 and rings 32, 34, 36, 38, 40 and 42 in attempting to completely disengage the loop therefrom. In the initial or starting position of the loop 44 as shown by the solid line of FIG. 1B, the loop encircles the uppermost post 18, passes through the aperture 17 in the neck annulus 16 and thereafter is connected to the ball 46 wherein the end of the loop is knotted. The loop end 47 is then moved as shown by the dotted line in FIG. 2 through rings 32, 34, 36, 38 and 40 in succession at all times maintaining each side member 48 and 50 thereof on its respective side of the vertically aligned posts 18, 20, 22, 24, 26 and 28. Upon completion of the first step the loop is drawn upward by pulling the ball 46 so that the loop end 47 encircles the bottom-most post 28 as shown by the solid line of FIG. 3. The loop is manipulated in a similar way through steps 2 to 54 inclusive as shown by the dotted lines of FIGS. 2–54, respectively, until it is positioned as shown in FIG. 54. By pulling upward on the ball when the loop 44 is positioned as shown in FIG. 53, it may be pulled through all of the rings and disengaged completely from the puzzle.

Although a six-ring embodiment has been considered, similar types of puzzles may be constructed of two, three, four etc., rings. Solutions similar to those for a six-ring puzzle are illustrated in FIGS. 55 to 60 for a two-ring puzzle, FIGS. 61 to 66 for a three-ring puzzle and FIGS. 67 to 78 for a four-ring puzzle. It is seen that the complexity of the solution increases dramatically with an increase in the number of rings. It can be appreciated that the bottom-most ring in each of the puzzle variants disclosed above plays no part in the solution of the puzzles and can therefore be omitted if desired.

It is also obvious that the frame structure to which the posts and rings are attached may be made of any convenient shape which can maintain the posts in a fixed spatial relationship relative to each other without departing from the spirit of the invention. The advantage of the type of construction disclosed herein however is the better accessibility it affords in manipulation of the loop end 47.

In this description and in some of the appended claims, terms such as "vertical," "horizontal," "top," "bottom" etc. have been used, for convenience to enable the reader to obtain a ready understanding of the invention. However, it is obvious that the user of the puzzle could, if he so wished, place it on its side or upside down or askew. The foregoing terms should accordingly be read in a relative rather than an absolute sense.

What I claim is:

1. A ring and loop puzzle comprising:

a vertically upstanding pair of spaced, substantially parallel rigid members joined at their bottom to a common rigid base portion, and at their top to a neck annulus, said neck annulus having an aperture therein;

a first and second set of horizontally extending posts aligned in a common vertical plane, with the vertical spacing between adjacent posts being substantially the same for all sets of adjacent posts, said first set of posts being of substantially uniform length and rigidly affixed to one of said members and said second set of posts being of substantially uniform length and rigidly affixed to the other of said members, the posts from the first set alternating with but only partially meshing with the posts of the second set; each said post having an eye at or near the free end thereof;

a plurality of closed rings of substantially equal diameter passing through respective eyes of said posts, the ring diameter being such that each ring, other than the two bottom-most rings, encircles (at least) two underlying posts between the eye and fixed end of each such underlying post; the ring next to the bottom ring encircling one underlying post; the bottom ring encircling no other posts;

a flexible closed loop line having a cross-section selected to permit its easy passage doubled through the aperture in the upper frame section and manipulation thereof in working the puzzle and a length sufficient to extend through the aperture in the upper frame section and through each of said rings in succession; and an object attached to said line of dimensions larger than the aperture in the neck annulus.

2. A ring and loop puzzle as defined in claim 1, wherein said neck annulus is in the form of a ring rigidly attached to said members, and said rigid base portion is also a ring whose axis is vertically disposed and whose diameter is large enough to stably support the puzzle structure on a horizontal plane surface.

3. A ring and loop puzzle as defined in claim 2, wherein the object is a solid generally spherical element having a central bore threaded at one end to receive a mating threaded plug and reduced in diameter at the other end to allow the passage therethrough of said line but to prevent the passage therethrough of a knotted end of said line.

4. A topological ring and loop puzzle comprising:

a neck annulus, a pair of substantially parallel depending columns fixed to and extending from circumferentially spaced portions of the neck annulus, p mutually spaced posts extending from the first of said columns in the direction of the second of said columns, the ends of said p posts spaced from the second column, q mutually spaced posts alternating with the p posts, spaced apart therefrom and extending from the second of said columns in the direction of the first of said columns, the ends of the said q posts spaced from the first column, the first p post being closest to the neck annulus, and (a) in the case where $p-q=0$, each of the p posts is provided with a connected ring whereby the 1st, . . . , (p−1) the ring encircles the 2nd, . . . pth post at a point nearer the first column than the point of connection of the ring connected to the encircled one of said p posts and also encircles the 1st, . . . (q−1)th post at a point nearer the second column than the point of connection of the ring connected to the encircled one of said q posts, respectively, and the pth ring encircles the qth post;

and at least the 1st, . . . , (q−1)th posts are each provided with a connected ring whereby the 1st, . . . , (q−1)th ring encircles the 2nd, . . . , pth post at a point nearer the first column than the point of connection of the ring connected to the encircled one of said p posts and also encircles the 2nd, . . . , qth post at point nearer the second column than the point of connection of the ring connected to the encircled one of said q posts, respectively;

(b) in the case where $p-q=1$, at least each of the 1st, . . . , (p−1)th posts is provided with a connected ring whereby the 1st, . . . (p−1)th ring encircles the 2nd, . . . , pth post at a point nearer the first column than the point of connection of the ring connected to the encircled one of said p posts and also encircles the 1st, . . . , qth post at a point nearer the second column than the point of connection of the ring connected to the encircled one of said q posts, respectively, and each of the q posts is provided with a connected ring whereby the 1st, . . . , (q−1)th ring encircles the 2nd, . . . , (p−1)th post at a point nearer the first column than the point of connection of the ring connected to the encircled one of said p posts and also encircles the 2nd, . . . , qth posts at a point nearer the second column than the point of connection of the ring connected to the encircled one of said q posts, respectively, and the qth ring encircles the pth post; the rings connected to the p posts being closer to the second column than to the first column and the rings connected to the q posts being closer to the first column than to the second column;

q being an integer of value at least 2;

said puzzle additionally comprising a flexible closed loop line having a length sufficient to permit passage of the doubled line through the neck annulus and all of the rings.

5. A puzzle as defined in claim 4, additionally comprising an object attached to the line to impede its passage through the neck annulus.

6. A ring and loop puzzle comprising:

a neck annulus, a pair of substantially parallel depending columns fixed to and extending from circumferentially spaced portions of the neck annulus, a first post or first set of two mutually spaced posts extending from the first of said columns, in the direction of the second of said columns, the end of the said first post or ends of said first set of two posts spaced from the second column, a second post extending from the second of said columns, in the direction of the first of said columns and spaced apart therefrom and having the first post or one post of the first set of two posts extending from the first of said columns interposed between said second post and the said neck annulus, the end of said second post spaced from the first column, and (a) in the case where there is only one post extending from the first of said columns it is provided with a connected ring which encircles the post extending from the second of said columns;

(b) in the case where there are two posts extending from the first of said columns, said second post is interposed between the posts of said first set of two posts, said one post nearest the annulus and said second post each being provided with connected rings, the rings of said one post encircling the other post extending from the first of said columns and said second post, the latter at a point nearer the second column than the point of connection of the ring connected to said second post, the former nearer the first column than the point of connection of the ring connected to said other post, and the ring of said second post encircling said other post, at a point nearer said first column than the point of connection of the ring connected to said other post, said puzzle additionally comprising a flexible closed loop line having a length sufficient to permit passage of the doubled line through the neck annulus and all of the rings.

* * * * *